US007171927B2

(12) United States Patent
Sano

(10) Patent No.: US 7,171,927 B2
(45) Date of Patent: Feb. 6, 2007

(54) CONTROL METHOD FOR ELECTRONICALLY CONTROLLED THERMOSTAT

(75) Inventor: Mitsuhiro Sano, Tokyo (JP)

(73) Assignee: Nippon Thermostat Co., Ltd., Kiyose (JP)

( * ) Notice: Subject to any disclaimer, the term of this patent is extended or adjusted under 35 U.S.C. 154(b) by 71 days.

(21) Appl. No.: 10/801,815

(22) Filed: Mar. 17, 2004

(65) Prior Publication Data

US 2004/0237911 A1 Dec. 2, 2004

(30) Foreign Application Priority Data

May 30, 2003 (JP) ..... 2003-154309

(51) Int. Cl.
*F01P 7/14* (2006.01)

(52) U.S. Cl. ..... 123/41.1; 123/41.49

(58) Field of Classification Search ..... 123/41.1, 123/41.12, 41.05, 41.49
See application file for complete search history.

(56) References Cited

U.S. PATENT DOCUMENTS 5,390,632 A * 2/1995 Ikebe et al. ..... 123/41.02
6,101,987 A 8/2000 Saur et al.
6,598,565 B2 * 7/2003 Fishman et al. ..... 123/41.1
6,688,262 B2 * 2/2004 Murakami et al. ..... 123/41.1
2003/0196612 A1 * 10/2003 Le Lievre et al. ..... 123/41.1

FOREIGN PATENT DOCUMENTS

JP 11-62584 3/1999
JP 11-294164 10/1999

* cited by examiner

*Primary Examiner*—Stephen K. Cronin
*Assistant Examiner*—Katrina Harris
(74) *Attorney, Agent, or Firm*—Oblon, Spivak, McClelland, Maier & Neustadt, P.C.

(57) ABSTRACT

A control method for an electronically controlled thermostat includes that an actuator is used for cooling-water control of an internal combustion engine and the actuator is capable of optionally varying the valve-opening ratio. An engine control unit computes a target temperature by means of various engine parameters and distributes the power distribution amount required to operate the actuator so that the cooling water temperature reaches the target temperature. The power distribution amount distributed to the actuator is determined by monitoring only the actual water temperature of the cooling water.

10 Claims, 3 Drawing Sheets

CONTROL METHOD FOR ELECTRONICALLY CONTROLLED THERMOSTAT

BACKGROUND OF THE INVENTION

1. Field of the Invention

The present invention relates to a control method for an electronically controlled thermostat capable of optionally varying the valve-opening ratio by installing a heater element in a temperature sensor, for example, in a cooling-water temperature control system for an internal combustion engine (hereinafter referred to as 'engine') that is employed in an automobile or the like.

2. Description of the Related Art

A water-cooling-type cooling device that employs a radiator is generally used in order to cool an automobile engine. Further, conventionally, with the objective of improving the fuel consumption of the automobile, this type of cooling device employs a control valve, such as a thermostat, for example, which adjusts the amount of cooling water circulated to the radiator to permit control of the temperature of the cooling water introduced to the engine. Known examples of such thermostats include those that employ a thermally expanding body (WAX or the like) as a temperature sensor or those that are electrically controlled, and so forth.

A thermostat of this kind is constituted such that the valve portion thereof is interposed in part of a cooling water passage. When the cooling water temperature is low, the valve portion is closed so that cooling water is circulated via a bypass passage without passing through the radiator, and, when the cooling water temperature is high, the valve portion is opened so that the cooling water is circulated via the radiator, whereby the temperature of the cooling water is controlled to the required state.

Further, it is generally known that automobile fuel consumption is improved by raising the cooling water temperature of the automobile engine.

In view of this situation, most recently, electronic-control type valves, that is, electronically controlled thermostats, have been widely adopted in order to provide the optimum water temperature to improve automobile fuel consumption.

Such an electronically controlled thermostat controls the cooling water temperature by optionally controlling the opening ratio of the valve portion and controlling a cooling fan that is attached to the radiator, whereby appropriate control of the cooling water temperature is possible. This is because control device (engine control module) that variably controls the above-mentioned electronically controlled thermostat is capable of performing control also through the addition of detected information such as a variety of parameters of the engine control unit such as the cooling water temperature, the outside air temperature, the automobile speed, the engine rotation speed, and throttle opening ratio, for example.

A multiplicity of different types of thermostat has been proposed conventionally as means for improving fuel consumption or as means for suppressing the generation of overshooting or undershooting by controlling the cooling water temperature at the required state, including an electronically controlled thermostat that is constituted to be capable of rendering the supply of engine-startup cooling water instantaneous and improving engine fuel consumption by mounting a heater element in the temperature sensor of the thermostat, combining power distribution control for this heater element, and using feedback control such as PID control for this power distribution control, for example.

An electronically controlled thermostat that is constructed to calculate the engine load and to control the thermostat valve-opening ratio (valve opening amount) and control the radiator cooling fan in accordance with the cooling water temperature (actual water temperature) by means of various parameters such as the cooling water temperature and automobile speed, for example, has been conventionally proposed (such as Japanese Patent Application Laid-Open No. H11-294164, for example).

Furthermore, an electronically controlled thermostat that is constituted to perform cooling-fan control in the required state by determining the thermostat's respective outputs to the heater and fan by comparing a threshold value with the actual water temperature, has been conventionally proposed (such as Japanese Patent Application Laid-Open No. H11-062584, for example).

Further, in the case of an electronically controlled thermostat in which a heater element is installed in a temperature sensor as mentioned earlier, after the power distribution control for the heater element has distributed power to the heater element installed in the temperature sensor, the response time until the valve opens and feedback to the water temperature occurs poses a problem. In other words, the response time must be made as short as possible in order to control the cooling water in the electronically controlled thermostat to a constant water temperature (hereinafter 'constant water temperature control') That is, constant water temperature control, whereby the response time can be shortened, can be implemented by applying a larger power-distribution amount variation to the heater element at an earlier time.

Here, where feedback control such as general PID control is concerned, although early prediction of a water temperature variation is implemented by means of the differential control itself, it is necessary to counteract the response delay of a mechanical part in the electronically controlled thermostat unit and predict a water temperature variation that shortens the time of the response delay. Here, the delay of a mechanical part in the electronically controlled thermostat unit is the time interval until power is distributed to the actuator and the valve operates. Further, a larger power-distribution amount variation cannot be applied to the heater element because the power distribution amount is an amount proportional to the water temperature gradient.

Therefore, for the reasons listed above, it is difficult to implement constant water temperature control of the electronically controlled thermostat by means of general PID control.

Furthermore, it is generally known that the thermostat open-valve temperature can also be set at a high temperature in order to implement the fuel consumption improvements of a higher water temperature. However, in the case of a conventional WAX-type thermostat control method, the difference in temperature between the thermostat open-valve temperature and fan-operating temperature is large (10° C. or more, for example). This is because the fan operating temperature has the characteristic of being set at the temperature at which the thermostat is fully open and the fan operating temperature is fixed at a temperature at which the engine does not break down, and it is therefore difficult to set the thermostat fully-open temperature boundlessly at a high value.

SUMMARY OF THE INVENTION

The present invention was conceived in view of this situation, an object thereof being to provide a control method for an electronically controlled thermostat that makes it possible to dispense with the inconvenience of the above-mentioned problems of the prior art and to implement high cooling-water temperature controllability, improved fuel consumption, and an improvement of the heater function and so forth with high accuracy and at low cost.

In order to achieve this object, the control method for an electronically controlled thermostat according to the invention in claim 1 of the present invention is a control method for an electronically controlled thermostat comprising an actuator that can be used for cooling-water control of an internal combustion engine and that is capable of optionally varying the valve-opening ratio, and an engine control unit that computes a target temperature by means of various engine parameters and distributes the power distribution amount required to operate the actuator so that the cooling water temperature reaches the target temperature, wherein the power distribution amount distributed to the actuator is determined by monitoring only the actual water temperature of the cooling water.

The control method for an electronically controlled thermostat according to the invention in claim 2 of the present invention defines claim 1 more specifically and is characterized in that the difference in the cooling-water temperature variation per unit time is read and the cooling-water temperature variation is predicted in accordance with this difference.

The control method for an electronically controlled thermostat according to the invention in claim 3 of the present invention defines claim 1 or 2 more specifically and is characterized in that a cooling fan disposed opposite a radiator for radiating the heat of the cooling water is provided; and the rotational speed of the radiator fan is controlled so that the difference between the actual water temperature of the cooling water and the water temperature when the valve is fully open by the distribution of power to the actuator or the water temperature when the valve is fully open in a state where the power distribution to the actuator is cut is zero.

The control method for an electronically controlled thermostat according to claim 4 of the present invention is a control method for an electronically controlled thermostat according to any one of claims 1 to 3, wherein the actuator is a heater element installed in a temperature sensor.

The control method for an electronically controlled thermostat according to claim 5 of the present invention is a control method for an electronically controlled thermostat according to claim 1 or 2, wherein the actuator is an electric motor that drives the valve to the open/closed state.

The present invention is capable of implementing the cooling water temperature suitably and efficiently in accordance with the engine load in a state where the automobile is operating. The present invention is superior in terms of its responsiveness and cooling-water temperature stability, is capable of suitably controlling the cooling water temperature to the required temperature without the risk of overshooting, undershooting, hunting, or the like, and is able to produce improved fuel consumption more reliably and over substantially the whole range of the operative states.

DESCRIPTION OF THE PREFERRED EMBODIMENTS

Figure 1:
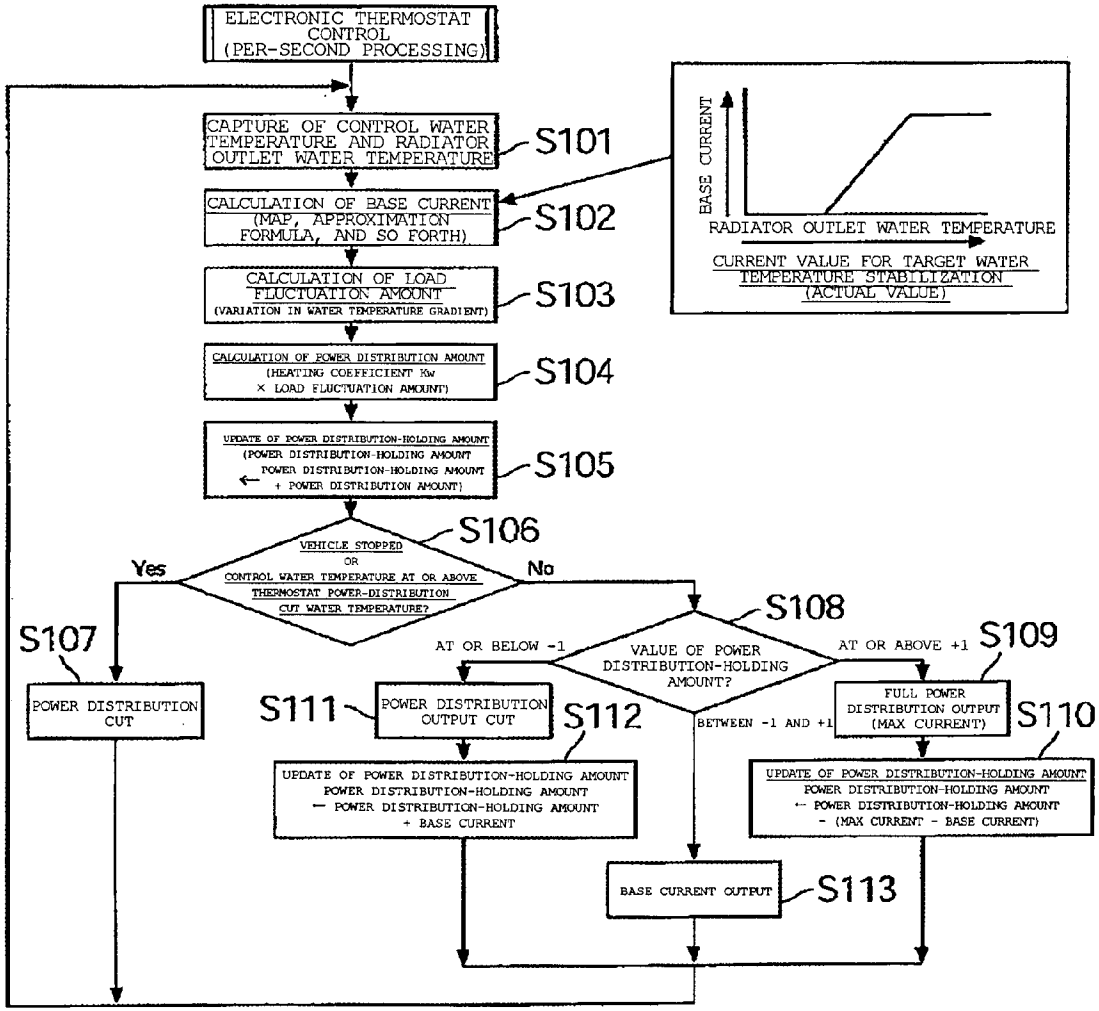
FIG. 1 is a flowchart that shows an embodiment of the control method for an electronically controlled thermostat according to the present invention and which serves to illustrate control of the electronically controlled thermostat.
Figure 2:
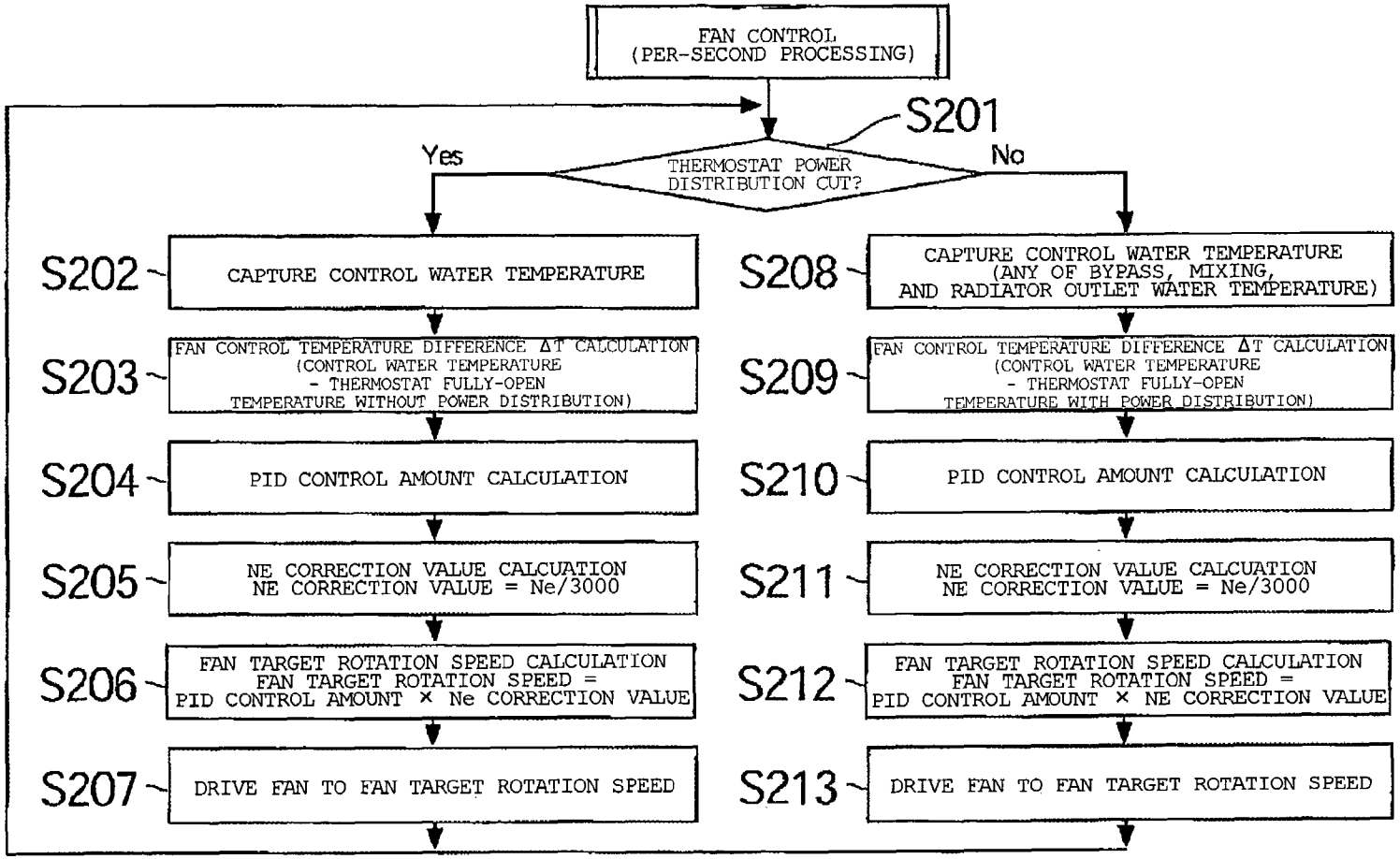
FIG. 2 is a flowchart to illustrate cooling-fan control by the electronically controlled thermostat according to the present invention.
Figure 3:
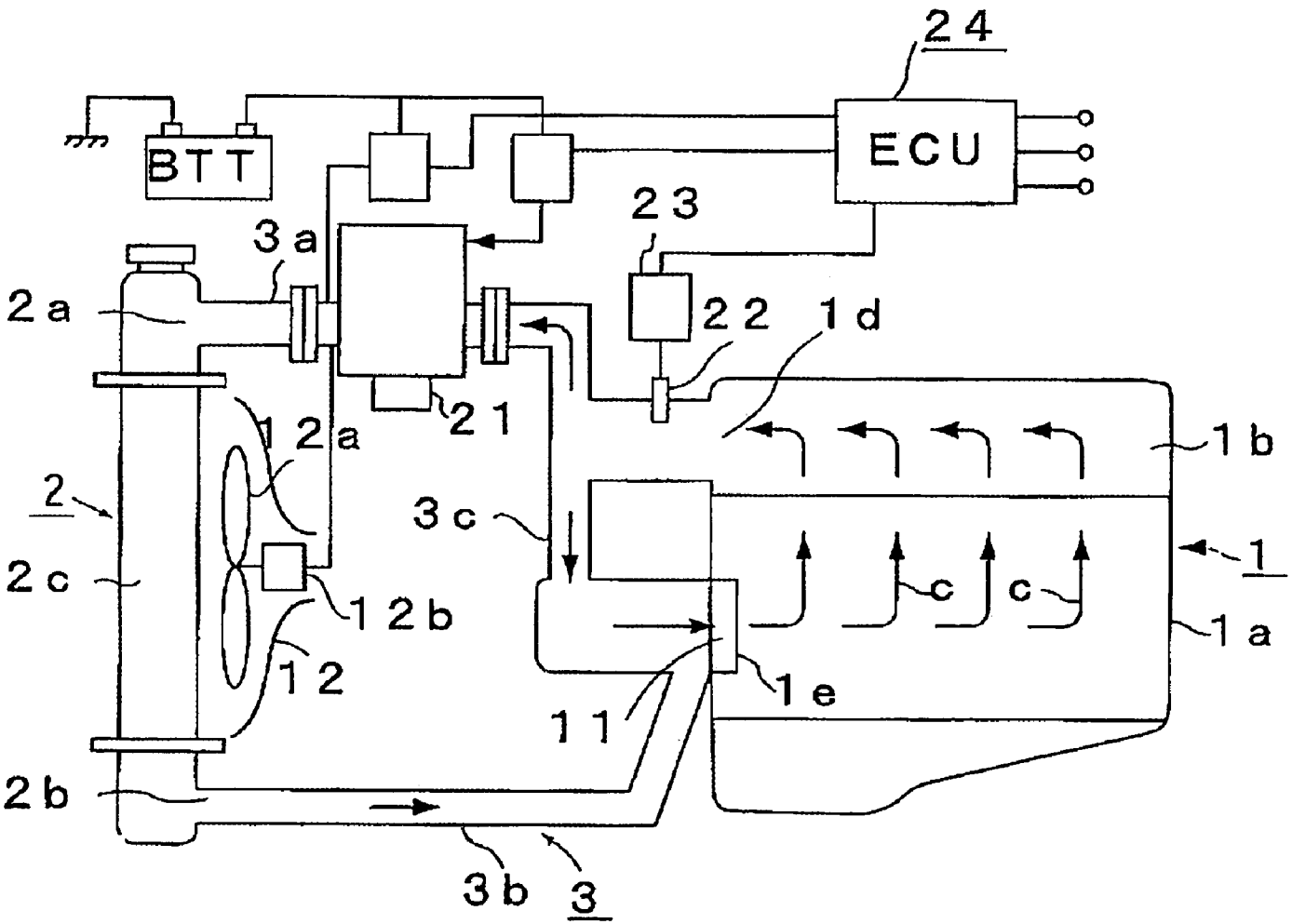
FIG. 3 is an outline view serving to illustrate a preferred engine cooling water temperature control system that applies the control method for an electronically controlled thermostat according to the present invention.

FIGS. 1 to 3 show one embodiment of the control method for an electronically controlled thermostat according to the present invention.

These figures will be first described below based on FIG. 3, which provides an overall outline of an automobile-engine cooling-water temperature control system that comprises an electronically controlled thermostat.

In FIG. 3, 1 is an automobile engine, which is an internal combustion engine constituted by a cylinder block 1*a* and a cylinder head 1*b*, in which a fluid path denoted by the arrow c is formed in the cylinder block 1*a* and cylinder head 1*b* of the engine 1.

2 is a heat exchanger, that is, a radiator. A fluid passage 2*c* is formed, as is common knowledge, in the radiator 2, and a cooling water inlet 2*a* and a cooling water outlet 2*b* of the radiator 2 are connected to a cooling water path 3 respectively that allows cooling water to be circulated between the radiator 2 and the engine 1.

This cooling water path 3 is constituted by an outflow cooling water path 3*a* that communicates between a cooling water outlet 1*d* provided at the top of the engine 1, and a cooling water inlet 2*a* provided at the top of the radiator 2; an inflow cooling water path 3*b* that communicates between a cooling water outlet 2*b* provided at the bottom of the radiator 2 and a cooling water inlet 1*e* provided at the bottom of the engine 1; and a bypass water path 3*c*, which connects a part midway along these cooling water paths 3*a* and 3*b*.

A cooling-medium circulation path is formed by the engine 1, radiator 2, and cooling water path 3.

Midway along the outflow cooling water path 3*a*, which is disposed between the cooling water outlet id provided at the top of the engine 1 and the cooling water inlet 2*a* provided at the top of the radiator 2, is provided an electronically controlled thermostat 21, which constitutes flow rate control means in the water path. A heater element is installed in the temperature sensor, for example, in the electronically controlled thermostat 21. A WAX+PTC-type thermostat or the like, which allows the valve-opening ratio to be optionally varied, may be used. Naturally, the electronically controlled thermostat 21 is not limited to this type of thermostat and may also be constituted such that a butterfly-type valve (hereinafter called a butterfly-type valve) is controlled to the open/closed state by means of the forward and reverse rotation of an electric motor so that the flow rate of the cooling water flowing out to the radiator 2 can be adjusted.

Further, a temperature-sensing element 22 such as a thermistor is installed as a water temperature sensor in the outflow cooling water path 3*a* that lies close to the cooling water outlet 1*d* in the engine 1. The detected value of this temperature sensing element 22, that is, information relating to the actual water temperature of the cooling water at the engine outlet, is converted by a converter 23 into data that can be identified by the engine control unit (hereinafter referred to as the 'ECU') 24 and can be supplied to the ECU 24, which controls the operative state of the engine 1 overall.

Furthermore, a signal, which indicates the operating state or non-operating state of a fan motor 12*b* in a fan unit 12 constituting forced cooling means, is also sent to the ECU 24.

Further, the reference symbol 11 in FIG. 3 is a water pump disposed in the inlet 1*e* section of the engine 1. This water pump serves to circulate cooling water forcedly when the rotational shaft of the engine 1 rotates due to the rotation of the crankshaft (not shown).

In addition, the reference symbol 12 is a fan unit for introducing a cooling air stream forcedly to the radiator 2, this fan unit 12 being constituted by a cooling fan 12*a* and an electric motor 12*b* that drive-rotates the cooling fan 12*a*.

According to the present invention, in an electronically controlled thermostat 21 comprising an actuator that can be used for cooling-water control of the engine 1 and that is capable of optionally varying the valve-opening ratio, which in this case is a heater element disposed in a temperature sensor, and an engine control unit that computes a target temperature by means of various engine parameters and distributes the power distribution amount required to operate the heater element so that the cooling water temperature reaches the target temperature, the power distribution amount distributed to the heater element is determined by monitoring only the actual water temperature of the cooling water.

Here, the determination of the power distribution amount does not determine the base current.

Further, this constitution makes it possible to suitably and efficiently implement the cooling water temperature irrespective of the load fluctuation of the engine 1 in the operative state of the automobile, is superior in terms of responsiveness and cooling-water temperature stability, is capable of suitably controlling the cooling water temperature without the risk of overshooting, undershooting, hunting, or the like occurring, and is able to achieve improved fuel consumption more reliably and over substantially the whole range of the operative states. In other words, the present invention permits enhanced water temperature controllability, improved fuel consumption through implementation of a higher water temperature and conservation of electric power, an enhanced heater function, and reduced fan operation noise.

Describing this in more detail, the present invention implements early prediction of the water temperature variation by using a water temperature gradient variation amount in the control of the electronically controlled thermostat 21, distributes power and cuts power distribution by means of the positive and negative values of these variation amounts, and determines the power distribution time by means of the size of the variation amount.

Accordingly, water temperature hunting, overshooting, and undershooting, which arise when the response time until the cooling water temperature is controlled to the target water temperature is long, can be rapidly reduced by means of the electronically controlled thermostat.

Further, the present invention employs a procedure that makes the base current that distributes power to the electronically controlled thermostat variable in accordance with a rise in the radiator outlet temperature, engine outlet temperature and engine inlet temperature.

Accordingly, it is possible to reduce the temperature difference between the open-valve temperature of the electronically controlled thermostat and the fan operating temperature. In addition, it is possible to shift the open-valve temperature of the electronically controlled thermostat to a higher temperature and raise the water temperature above conventional temperatures when the automobile is stopped and operating normally, whereby fuel consumption can be improved.

Furthermore, when the automobile is stopped, the distribution of power to the electronically controlled thermostat is cut. High power distribution to the thermostat 21 may also be cut when a high temperature is assumed, as is the case when the thermostat is fully open when this power distribution is OFF.

FIG. 1 is a flowchart showing control of the electronically controlled thermostat 21 (electronic thermostat control).

Control of the electronically controlled thermostat 21 (per-second processing) may be described as follows. That is, the control water temperature and radiator outlet water temperature are captured in step (abbreviated to 'S' below) 101. The processing frequency can be optionally set.

The processing then moves on to S102 and the calculation of the base current is found from a MAP, whose parameter is the radiator outlet water temperature, and from an approximation formula. This base current is the current value required in order to maintain the target water temperature.

In S103, the calculation of the load fluctuation amount is carried out by calculating the amount of variation in the water temperature gradient. This water temperature gradient is not the difference of the actual water temperature in relation to the target water temperature. Rather, this water temperature gradient is theater-temperature variation amount per unit time. The units are [° C./S].

Accordingly, the variation in the water temperature gradient is the difference in the variation of the water temperature per unit time, and hence the units are [° C./S2].

In S104, the calculation of the power distribution amount is found from the product of the heating coefficient Kw and load variation amount. Here, the heating coefficient Kw is a constant that is established by means of the thermostat and engine circuit, and so forth, and is not a value that fluctuates as indicated in a map or the like.

In S105, the power distribution-holding amount is updated by adding the power distribution amount to the power distribution-holding amount.

In S106, it is judged whether the automobile is stopped or the control water temperature is at or above the thermostat power-distribution cut water temperature. If this is the case, the processing moves on to S107 to cut the power distribution, whereupon the processing returns to S101.

Here, the thermostat power-distribution cut water temperature (constant) is a control water temperature lower-limit value that makes it possible to retain the fully open state of the thermostat without power distribution.

In S106, when it is judged that the automobile is stopped or the control water temperature is at or above the thermostat power-distribution cut water temperature, the processing moves on to S108 in which the value of the power distribution-holding amount is ascertained. That is, if the value of the power distribution-holding amount is mainly at or above +1 for which the water temperature curve is upward-facing and has a U shape, the processing moves on to S109 in which full power distribution output is performed. Full power distribution is performed until the result of updating the power distribution-holding amount in S110 that follows is equal to or less than +1. Further, the power distribution-holding amount is proportionate to the size of the water temperature curve and therefore the power distribution time increases and decreases in proportion to the size of the water temperature gradient.

The processing then moves on to S110 and returns to S101 after the power distribution-holding amount has been updated.

When it is judged in S108 that the value of the power distribution-holding amount is mainly at or below −1 for which the water temperature curve faces downward and has a U shape, the power distribution output is cut in S111, and, after the power distribution-holding amount is updated in S112, the processing returns to S101. The time interval for the power distribution cut is implemented until the result of updating the power distribution-holding amount in S112 that follows is −1 or less. Further, the power distribution-holding amount is proportionate to the size of the water temperature curve and therefore the power distribution time increases and decreases in proportion to the size of the water temperature gradient.

Meanwhile, when it is judged that the water temperature gradient (water temperature curve) is zero, that is, when the water temperature is constant, or when the water temperature gradient is between −1 and 1 when the water temperature rises and falls with a fixed gradient, the base current is output in S113, whereupon the processing returns to S101.

FIG. 2 is a flowchart of fan control that is combined with the control of the electronically controlled thermostat mentioned above. The processing frequency can be optionally set.

It is judged in S201 whether the power distribution to the thermostat 21 has been cut, and in a state where the power distribution to the thermostat has been cut, the processing moves on to S202 in which the control water temperature is captured. The fan control temperature difference ΔT is then calculated in S203.

That is, the fan-control temperature difference ΔT is calculated by reducing the thermostat fully-open temperature without power distribution from the control water temperature. Here, the thermostat fully-open temperature without power distribution is the fully open temperature of the thermostat in a state where the power distribution has been cut, that is, a temperature at which the thermostat unit is fully open.

Thereafter, the processing moves on to S204 and the PID control amount corresponding with the fan control temperature difference ΔT is calculated. Next, the correction value for the engine rotation speed Ne is calculated in S205.

The fan target rotation speed is calculated in S206 by adding together the PID control amount and the correction value for the engine rotation speed Ne. The cooling fan 12 of the radiator 2 is then driven to the fan target rotation speed corresponding with the control amount in S207. Thereafter, the processing returns to S201 and the same routine is repeated subsequently. Here, the operation of the fan target rotation speed at the engine rotation speed Ne serves to enhance the water temperature controllability.

Meanwhile, when it is judged in S201 that the power distribution to the thermostat has been cut, the processing moves on to S208, whereupon the control water temperature (any of the bypass, mixing, radiator outlet water temperatures) is captured. The fan control temperature difference ΔT is then calculated in S209.

That is, this fan control temperature difference ΔT is calculated by reducing the thermostat fully-open temperature with power distribution from the control water temperature. Here, the thermostat fully-open temperature with power distribution is the fully open temperature of the thermostat in an distribute state.

The processing then moves on to S210, whereupon the PID control amount corresponding with the fan control temperature difference ΔT is calculated. Next, the correction value for the engine rotation speed Ne is calculated in S211. Further, in S212, the fan target rotation speed is calculated by adding together the PID control amount and correction value for the engine rotation speed Ne.

The cooling fan 12 of the radiator 2 is then driven to the fan target rotation speed corresponding with the control amount in S213. Thereafter, the processing returns to S201 and the same routine is repeated subsequently.

Further, PID control is carried out in S203 and S209 so that the fan control temperature difference ΔT is zero and this PID control may be achieved simply by providing a ΔT data table.

In FIG. 2 above, the division of steps into two depending on whether the distribution of power to the thermostat has been cut is aimed at achieving an additional improvement in fuel consumption in cases where the automobile is stopped when there is no engine load.

That is, the fan target temperature is lowered by adding the power distribution to the PTC when the automobile is operating and is held at a water temperature whose upper limit is the water temperature at which engine over heating is a voided. On the other hand, when the automobile is stopped, there is no engine load and hence there is a slight margin for engine overheating and the temperature sensor can be set at a temperature that is higher than conventional temperatures. Therefore, the PTC power distribution can be cut as the fan operating temperature is raised, whereby electrical power conservation can be implemented.

Further, it is understood that the present invention is not limited to the structure described in the above embodiment, it being possible to suitably modify the shape of each part and change the structure, and so forth.

For example, the electronically controlled thermostat employed may be an electronically controlled thermostat that allows water temperature control to be optionally performed, such as a WAX+PTC-type thermostat that is made cooling water temperature-independent by combining a heating body such as a PTC with a thermostat that employs WAX (a thermally expanding body), for example. However, the electronically controlled thermostat is not restricted to this type of thermostat and may instead be an electronically controlled thermostat of a system that employs an electric motor drive-type butterfly valve (flow rate control valve) or the like. Nor is the heater element restricted to a PTC thermistor and may be any element as long as same is a heating body. In addition, a bimetal or shape memory alloy (SMA) may be used instead of WAX.

Further, the water temperature sensor, which senses the actual water temperature of the cooling water, may be provided at the engine outlet or inlet and at the radiator outlet, and so forth.

As described above, with the control method for an electronically controlled thermostat according to the present invention, after the current value to be distributed to the actuator is determined by monitoring only the actual water temperature of the cooling water, the cooling water temperature can be appropriately and efficiently implemented irrespective of an engine load fluctuation in the operative state of the automobile. Hence, the control method is superior in terms of responsiveness and cooling-water temperature stability, and exhibits a variety of superior effects such as that of being able to suitably control the cooling water temperature to the required temperature without the risk of overshooting, undershooting, hunting, or the like occurring, and that of being able to achieve improved fuel consumption more reliably and over substantially the whole range of the operative states.

In other words, according to the present invention, it is possible to obtain a control method for an electronically controlled thermostat that affords effects such as those of permitting enhanced water temperature controllability, improved fuel consumption through implementation of a higher water temperature and increased conservation of electric power, an enhanced heater function, and reduced fan operation noise.

In addition, because the present invention performs thermostat control by monitoring only the actual water temperature of the cooling water, there is also the advantage that a sensor for monitoring the valve-opening ratio of the thermostat is no longer required and cost reductions are therefore achievable.

Furthermore, according to the present invention, the actual water temperature of the cooling water is monitored and therefore the best set water temperature can be determined for the automobile at the design stage according to drivers' driving styles, automobile cooling-system layouts and individual differences between thermostats.

What is claimed is:

1. A method for controlling an electronically controlled thermostat comprising:

providing an actuator configured to vary a valve-opening ratio so as to control a temperature of cooling-water to an internal combustion engine and an engine control unit configured to compute a target temperature based on engine parameters and to distribute a power to the actuator;

monitoring only an actual temperature of the cooling water flowing out from a cooling water outlet of the internal combustion engine;

determining an amount of the power to be distributed to the actuator based on the actual temperature of the cooling water; and distributing the amount of the power required to operate the actuator such that the temperature of the cooling water reaches the target temperature, wherein said determining comprises reading a difference in a variation of the actual temperature of the cooling water per unit time and predicting the variation of the actual temperature of the cooling water in accordance with the difference.

2. The method for controlling an electronically controlled thermostat according to claim 1, wherein the providing further comprises providing a cooling fan disposed opposite a radiator for radiating heat of the cooling water, and a rotational speed of the cooling fan is controlled so that a difference between the actual temperature of the cooling water and a temperature of the cooling water when the valve is fully open by the amount of the power distributed to the actuator or a temperature of the cooling water when the valve is fully open in a state where the amount of the power distributed to the actuator is cut to zero.

3. The method for controlling an electronically controlled thermostat according to claim 2, wherein the actuator comprises a temperature sensor and a heater element installed in the temperature sensor.

4. The method for controlling an electronically controlled thermostat according to claim 1, wherein the actuator comprises a temperature sensor and a heater element installed in the temperature sensor.

5. The method for controlling an electronically controlled thermostat according to claim 1, wherein the actuator comprises a valve and an electric motor configured to drive the valve to open/closed state.

6. The method for controlling an electronically controlled thermostat according to claim 1, wherein said difference comprises a variation amount of water temperature gradient, said amount of power comprises a power distribution time, and said determining compromises determining a positive or negative value of the variation amount and the power distribution time based on a size of the variation amount.

7. A method for controlling a temperature of cooling water of an internal combustion engine, comprising:

providing an actuator configured to adjust an amount of the cooling water flowing to the internal combustion engine;

monitoring only the temperature of the cooling water flowing out from a cooling water outlet of the internal combustion engine;

computing a target temperature based on engine parameters; and controlling the actuator according to the monitored temperature so that the temperature of the cooling water approaches the target temperatures, wherein said controlling comprises reading a difference in a variation of the temperature of the cooling water per unit time and predicting the variation of the temperature of the cooling water in accordance with the difference.

8. The method for controlling a temperature of cooling water of an internal combustion engine according to claim 7, wherein the actuator comprises a temperature sensor and a heater element installed in the temperature sensor.

9. The method for controlling a temperature of cooling water of an internal combustion engine according to claim 7, wherein the actuator comprises a valve and an electric motor configured to drive the valve to open/closed state.

10. The method for controlling a temperature of cooling water of an internal combustion engine according to claim 7, wherein said difference comprises a variation amount of water temperature gradient, said amount of power comprises a power distribution time, and said determining comprises determining a positive or negative value of the variation amount and the power distribution time based on a size of the variation amount.

* * * * *